US007111530B2

(12) United States Patent
Huang

(10) Patent No.: US 7,111,530 B2
(45) Date of Patent: Sep. 26, 2006

(54) SCREWDRIVER FAST CONNECTOR

(76) Inventor: Ping Wen Huang, Np. 5, Alley 24, Lane 247, Sinyi St., Wurih Township, Taichung County 414 (TW)

( * ) Notice: Subject to any disclaimer, the term of this patent is extended or adjusted under 35 U.S.C. 154(b) by 0 days.

(21) Appl. No.: 11/166,135

(22) Filed: Jun. 27, 2005

(65) Prior Publication Data

US 2005/0284270 A1 Dec. 29, 2005

(30) Foreign Application Priority Data

Jun. 28, 2004 (TW) ..... 93210139 U

(51) Int. Cl.
*B25B 23/00* (2006.01)
*B25B 23/16* (2006.01)

(52) U.S. Cl. ..... 81/438; 81/177.85

(58) Field of Classification Search ..... 81/125, 81/177.2, 177.85, 180.1, 438
See application file for complete search history.

(56) References Cited

U.S. PATENT DOCUMENTS 3,255,792 A * 6/1966 Beck ..... 81/490
5,996,452 A * 12/1999 Chiang ..... 81/429
6,722,667 B1 * 4/2004 Cantlon ..... 279/22
6,920,810 B1 * 7/2005 Thompson et al. ..... 81/177.85
6,953,196 B1 * 10/2005 Huang ..... 279/75
6,973,858 B1 * 12/2005 Huang ..... 81/177.85
2005/0045002 A1 * 3/2005 Cluthe ..... 81/177.85

* cited by examiner

*Primary Examiner*—David B. Thomas
(74) *Attorney, Agent, or Firm*—Rosenberg, Klein & Lee

(57) ABSTRACT

A screwdriver fast connector is comprised of a shank including an insertion channel, an accommodation hole with a coil, an accommodation channel, and an elastic member penetrating the shank in radius; a locking member including a steel bead; and a slide member including a sleeve, an elastic member and a C-clamp, a first accommodation and a second accommodation spaces being provided to the sleeve; and the steel bead holding against a retaining part between both accommodation spaces so to fast mounting and removal of the tip by moving the steel bead.

2 Claims, 4 Drawing Sheets

SCREWDRIVER FAST CONNECTOR

BACKGROUND OF THE INVENTION (a) Field of the Invention

The present invention is related to a screwdriver fast connector, and more particularly, to one adapted with a locking member and a slide member to allow easy mounting, faster removal, and to be reliably locked when mounted to a tip of the screwdriver.

(b) Description of the Prior Art

As illustrated in FIGS. 6, and 8, a fast removal device of a screwdriver connector is essentially comprised of a flute 71 provided to a body 7 of the device to accommodate a coil 72 and a straight part 721 is left to be restricted in the flute 71 while being exposed out of an accommodation channel 73 to engage with a slot 81 from a tip 8.

Accordingly, once the tip 8 is pushed into the accommodation channel 73, the straight part 721 is pushed towards the outer edge of the body 7. When the pressure disappears, the straight part 721 is inserted into the slot 81 of the tip 8 to secure the tip 8 in position. When a slide sleeve 74 is moved, it pushes the straight part 721 to retreat into the flute 71, and the tip 8 is ejected out by an elastic member 75 disposed at the bottom of the body 7.

However, the process to provide the flute 71 is complicate and prevents easy control of precision resulting in the absence of a consistent positioning for the straight part 721. If the straight part 721 sticks out too much from the accommodation channel 73, the coil 72 can easily get stuck to the wall of the accommodation channel 73 so to prevent easy placement of the tip 8. Upon removing the bit 8, the coil 72 is also vulnerable to get stuck to the wall of the accommodation channel 73 to prevent easy retreat of the bit 8. Furthermore, if the straight part 721 is short of sticking out from the accommodation channel 73, it fails to secure the slot 81 of the bit 8; and the bit 8 can be easily slip out of the accommodation channel 73 while driving.

SUMMARY OF THE INVENTION

The primary purpose of the present invention is to provide an improved structure of a screwdriver fast connector that allows easier mounting and faster removal of a tip of the screwdriver.

To achieve the purpose, a screwdriver fast connector of the present invention is comprised of a shank, a locking member and a slide member. An insertion channel is provided to the shank to receive the placement of the tip and an accommodation hole is connected through the bottom of the insertion channel and adapted with a coil. The coil under normal condition is partially protruding from the accommodation hole to generate the force needed to eject the bit. An accommodation channel is axially disposed to the outer edge of the shank and the distal end of the accommodation channel from the accommodation hole is disposed with an elastic member penetrating the shank in radius. The locking member includes a steel bead and an elastic member. The elastic member is installed in the accommodation channel; and the steel bead is installed in the accommodation channel at the approximate end towards the radius hole to protrude into the insertion channel as pushed against by the elastic member. The slide member includes a sleeve, an elastic member and a C-clamp. The sleeve is disposed to the outer edge of the shank and adapted with a recess and a C-shaped slot on the inner edge of the sleeve. The elastic member is placed in the recess and holds against a flange provided externally to the shank. The C-clamp inside the C-shaped slot locks up the distal end of the flange away from the elastic member to keep the sleeve from falling out of the shank. Under normal condition, a first accommodation space and a second accommodation spaces are provided to the sleeve in relation to where the steel bead is located. A retaining part is defined between the first and the second accommodation spaces to be held against by the steel bead at where in relation to the location of the steel bead. The other side of the second accommodation space in relation to the retaining part of the second accommodation space closer to the side of the accommodation hole is where the first accommodation space is located. Once the tip is inserted into the insertion channel, the steel bead as pushed by the tip slides into the second accommodation space. To remove the tip, the sleeve is moved for the steel bead to enter into the first accommodation space where the coil will push out the tip. Accordingly, the present invention provides a fast connector to easily mount and dismount the tip of a screwdriver.

DETAILED DESCRIPTION OF THE PREFERRED EMBODIMENTS

Figure 1:
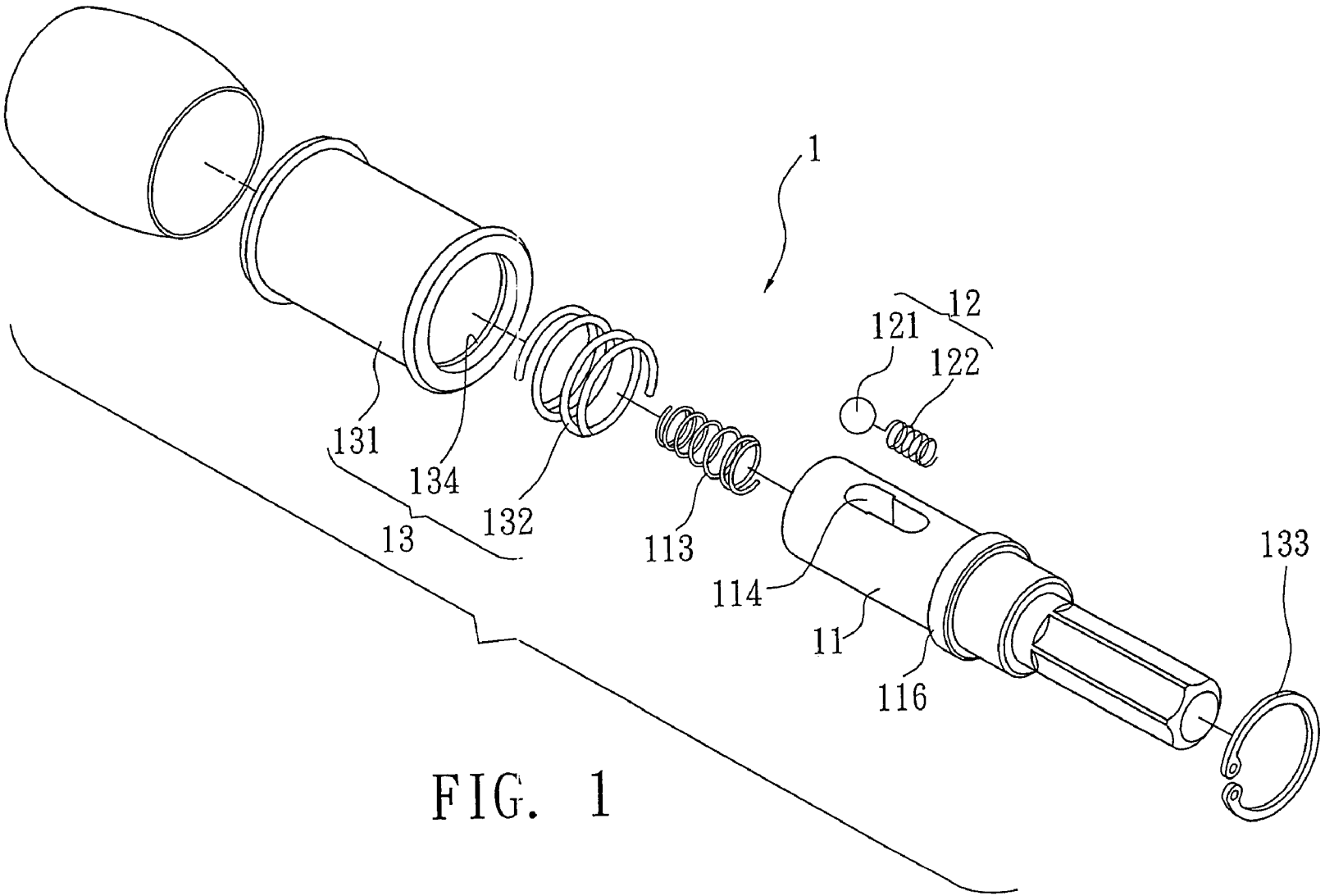
FIG. 1 is an exploded view of the present invention.
Figure 2:
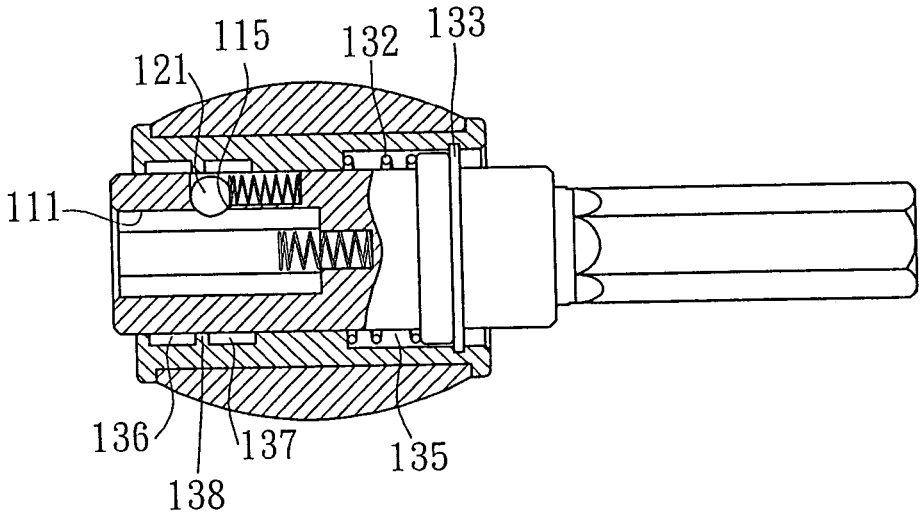
FIG. 2 is a schematic view showing the operation of the present invention.
Figure 3:
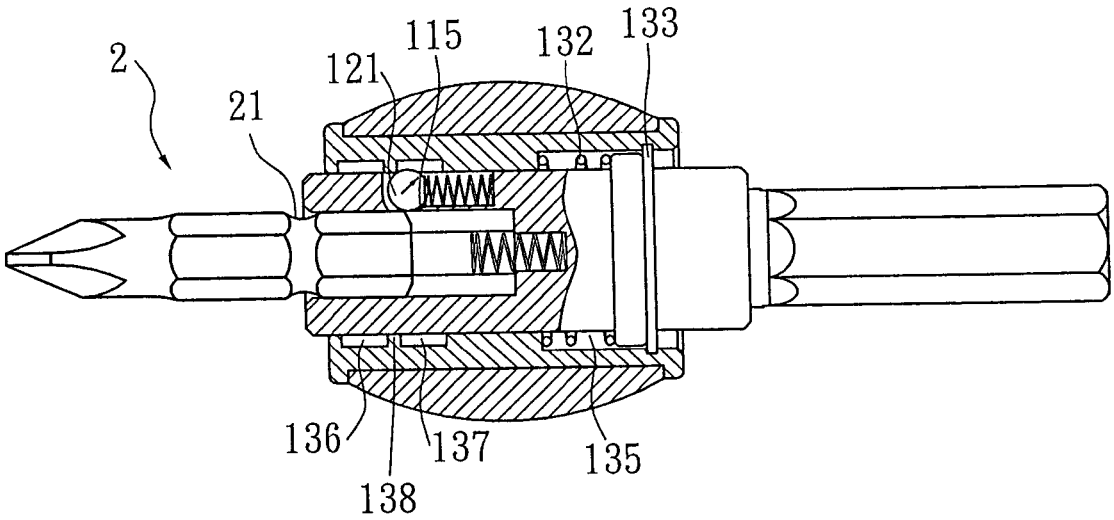
FIG. 3 is another schematic view showing the operation of the present invention.
Figure 4:
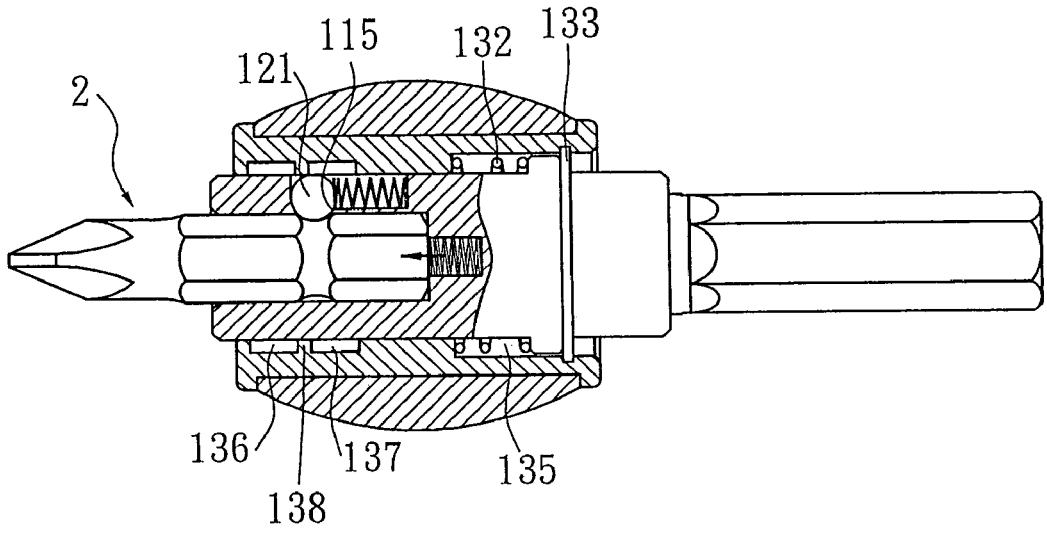
FIG. 4 is another schematic view yet showing the operation of the present invention.
Figure 5:
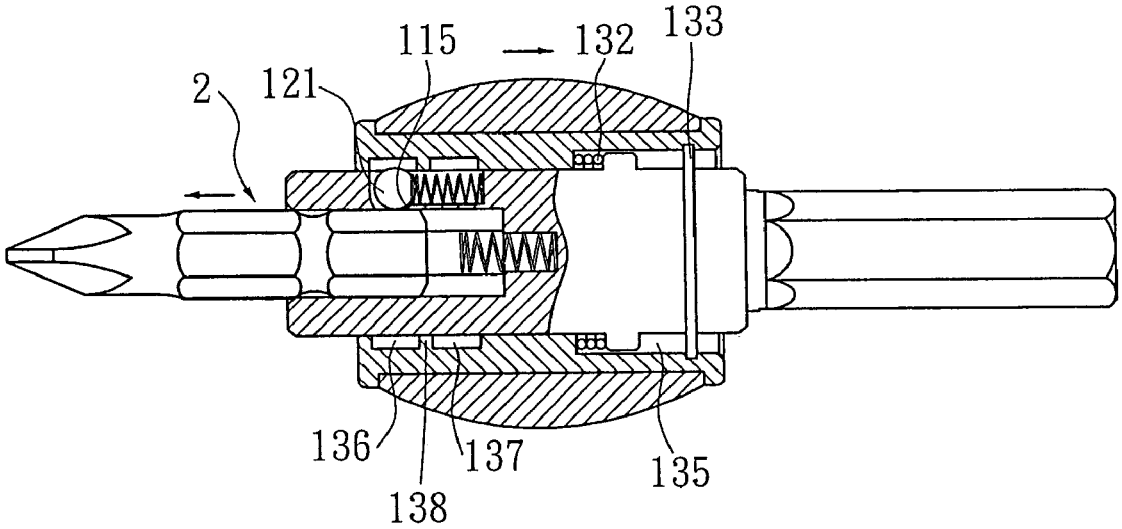
FIG. 5 is another schematic view yet showing the operation of the present invention.
Figure 6:
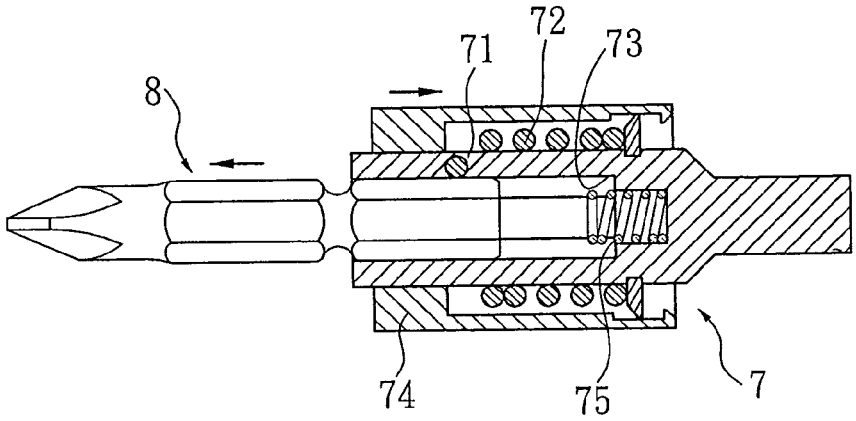
FIG. 6 PRIOR ART
FIG. 6 is a schematic view showing the operation of the prior art.
Figure 7:
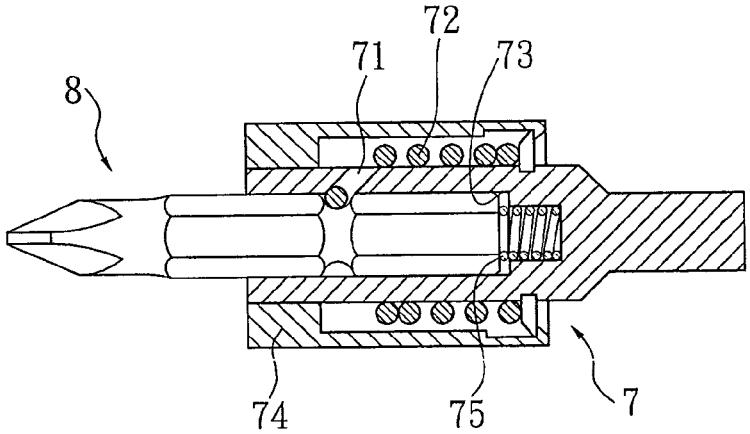
FIG. 7 PRIOR ART
FIG. 7 is a schematic view showing the operation of the prior art.
Figure 8:
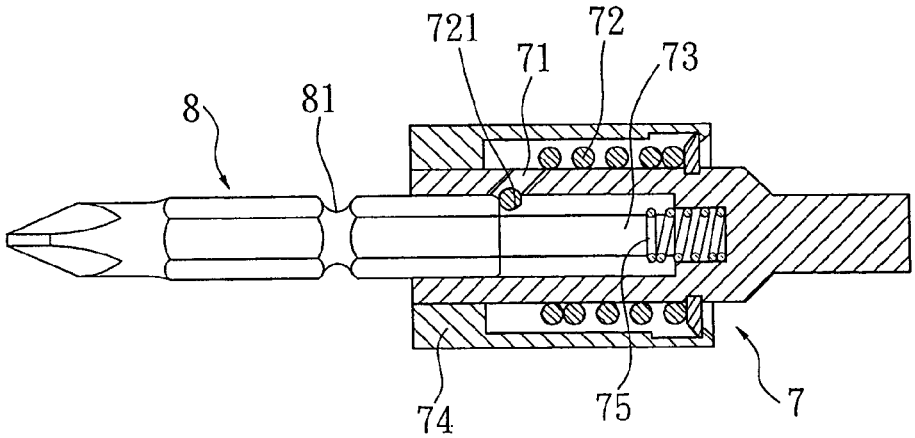
FIG. 8 PRIOR ART
FIG. 8 is a schematic view showing the operation of the prior art.

Referring to FIGS. 1 through 5 for a preferred embodiment selected for the description of the present invention, it is to be noted that the claims made hereunder are not restricted by the construction disclosed in the preferred embodiment.

As illustrated, the preferred embodiment of the present invention relates to an improve construction of a screwdriver fast connector 1 comprised of a shank 11, a locking member 12, and a slide member 13. An insertions channel 111 is disposed to the shank 11 to receive insertion of a tip 2 of the screwdriver. An accommodation hole 112 is connected through the bottom of the insertion channel 111. The accommodation hole 112 is tightly engaged with a coil 113 and the coil 113 under normal conditions partially protrudes out of the accommodation hole 112 to produce the force need to eject the tip 2. An accommodation channel 114 is axially disposed to the outer edge of the shank 11, and a hole 115 penetrating through the shank 11 is disposed in radius at the distal end of the accommodation channel 114 away from the accommodation hole 112. The locking member 12 includes a steel bead 121 and an elastic member 122. The elastic member 122 is installed in the accommodation channel 114, and the steel bead 121 is installed also in the accommodation hole 114 at the approximate end towards the through hole 115. The steel bear protrudes from the insertion channel 11 as pushed against by the elastic member 122. The slide member 13 includes a sleeve 131, an elastic member 132, and a C-clamp 133. The sleeve 131 is disposed to the outer edge of the shank 11 and adapted with a C-shaped slot 134, a recess 135 on the inner edge of the sleeve 131. The elastic member 132 is placed in the recess 135 and holds against a flange 116 provided externally to the shank 11. The C-clamp 133 inside the C-shaped slot 134 locks up the distal end of the flange 116 away from the elastic member 132 to keep the sleeve 131 from falling out of the shank 11. Under normal condition, a first accommodation space 136 and a second accommodation space 137 are provided to the sleeve in relation to where the steel bead 121 is located. A retaining part 138 is defined between the first and the second accommodation spaces 136, 137 to be held against by the steel bead 121 at where in relation to the location of the steel bead 121. The other side of the second accommodation space 137 in relation to the retaining part 138 of the second accommodation space 137 closer to the side of the accommodation hole 112 is where the first accommodation space 136 is located. Once the tip 2 is inserted into the insertion channel 111, the steel bead 121 as pushed by the tip 2 slides into the second accommodation space 137. To remove the tip, the sleeve 131 is moved for the steel bead 121 to enter into the first accommodation space 136 where the coil 113 will push out the tip 2. Accordingly, the present invention provides a fast connector to easily mount and dismount the tip of a screwdriver.

The steel bead 121 is compressed by the bit 2 when placed into the insertion channel 111 thus to push the elastic member 122 to compress for the steel bead 121 to easily move into the second accommodation space 137. Once the tip 2 is completely placed into the insertion channel 111, the retaining part 138 causes the steel bead 121 to be pushed back into a slot 21 of the tip 2 to secure the tip 2. Upon moving the slide member 13, the first accommodation space 136 is moved to where close to the steel bead 121 so that when the bit 2 is ejected out of the insertion channel 111 by the coil 113, the slot 21 of the bit 2 pushes the steel bead 121 to the first accommodation space 137 to easily remove the tip 2.

Furthermore, to secure a solid holding, an anti-slip sleeve is further disposed to the outer edge of the slide member 13.

I claim:

1. A screwdriver fast connector is comprised of a shank, a locking member, and a slide member; an insertion channel being provided to the shank, an accommodation hole being connected through the bottom of the insertion channel and tightly engaged with a coil, the coil in normal status partially protruding out of the accommodation hole to produce the force needed to eject a tip of the screwdriver, an accommodation channel being axially disposed to the outer edge of the shank; a hole penetrating through the shank being disposed in radius on the distal end of the accommodation channel away from the accommodation hole; the locking member including a steel bead and an elastic member, the elastic member being installed in the accommodation channel, the steel bead being installed in the accommodation channel at the approximate end towards the hole in radius; the steel bead protruding out of the insertion channel as pushed by the elastic member; the slide member including a sleeve, an elastic member, and a C-clamp; the sleeve being disposed to the outer edge of the shank, a recess and a C-shaped slot being disposed on the inner edge of the sleeve, the elastic member being installed in the recess to hold against a flange disposed to the outer edge of the shank, the C-clamp installed in the C-shaped slot locks up the other side of the flange away from the elastic member to keep the sleeve from falling off the shank 11, the sleeve in normal status being disposed at where in relation to the location of the steel bead a first and a second accommodation spaces, a retaining part being defined between the first and the second accommodation spaces, the retaining part under normal status being held against by the steel bead at where in relation to the location of the steel bead, and the first accommodation space being located on the other side of the second accommodation space in relation to the retaining part of the second accommodation space closer to the side of the accommodation hole.

2. The screwdriver fast connector of claim 1, wherein an anti-slip sleeve is further disposed to the outer edge of the slide member.

* * * * *